US005540211A

United States Patent [19]

Ahern

[11] Patent Number: 5,540,211

[45] Date of Patent: Jul. 30, 1996

[54] POCKET HEAT EXCHANGER

[75] Inventor: Michael D. Ahern, Fond du Lac, Wis.

[73] Assignee: Harbridge, Inc., Fond du Lac, Wis.

[21] Appl. No.: 243,152

[22] Filed: May 16, 1994

[51] Int. Cl.[6] ..... F24H 3/02

[52] U.S. Cl. ..... 126/110 R; 126/110 A; 126/116 R

[58] Field of Search ..... 126/110 R, 110 A, 126/110 B, 116 R

[56] References Cited

U.S. PATENT DOCUMENTS

| | | | |
|---|---|---|---|
| 3,106,200 | 10/1963 | Muckelrath | 126/109 X |
| 3,164,145 | 1/1965 | Tolson | 126/110 B |
| 3,822,991 | 7/1974 | Mutchler | 126/110 B X |
| 3,871,354 | 3/1975 | Jackson et al. | 126/110 B X |
| 5,022,379 | 6/1991 | Wilson, Jr. | 126/110 R |
| 5,295,473 | 3/1994 | Neufeldt | 126/110 K X |

*Primary Examiner*—Larry Jones
*Attorney, Agent, or Firm*—Donald Cayen

[57] ABSTRACT

A pocket heat exchanger comprises an elongated combustion chamber that defines a plane passing through the combustion chamber longitudinal axis. A two-pass, three-pass, or four-pass duct system is arranged symmetrically about the plane to conduct hot products of combustion produced in the combustion chamber in parallel paths to a flue. The pocket heat exchanger is installable as a modular unit into the pocket of a recirculatory fluid system. The symmetrical design of the pocket heat exchanger assures that a stream of recirculating gas flowing past the pocket heat exchanger is heated to have a uniform temperature across its cross section. A shroud partially surrounding the combustion chamber and the duct system aids in directing the recirculating gas to thoroughly scrub the combustion chamber for maximum heat transfer to and temperature uniformity of the stream of gas. The flue for the products of combustion may pass through the stream of recirculating gas, or it may pass outside the stream of the gas.

55 Claims, 4 Drawing Sheets

POCKET HEAT EXCHANGER

BACKGROUND OF THE INVENTION

1. Field of the Invention

This invention pertains to heat transfer, and more particularly to apparatus for transferring heat in recirculatory fluid systems.

2. Description of the Prior Art

Various equipment and methods have been developed to raise the temperature of a fluid inside an enclosure and to employ the heated fluid for useful purposes outside the enclosure. Important applications of such equipment and methods include recirculatory systems. In a recirculatory system, a recirculating fluid flows in a generally closed loop through a first enclosure where it is heated, through a second enclosure where the heated fluid is utilized, and back to the first enclosure for reheating. Typically, the recirculating fluid is heated by a heat exchanger that burns oil or gas in a combustion chamber. Elongated ducts conduct the hot products of combustion from the combustion chamber to a flue. The fluid flows past the heat exchanger ducts and combustion chamber to be heated by the hot products of combustion therein. Well known examples of recirculatory fluid systems include ovens, dryers, and climate control systems.

In many recirculatory fluid systems, recirculating air is heated by a heat exchanger that is located inside a relatively small pocket that forms a part of the system. The heated air flows through the pocket to a much larger working chamber in which the hot air heats, dries, or otherwise affects objects or persons in the working chamber. The cooled recirculating air then flows back to the pocket for reheating.

For several reasons, prior heat exchangers used in many recirculatory fluid systems have not been completely successful. One reason for unsatisfactory performance is that the space available for the heat exchanger is usually quite limited. Prior heat exchangers that could fit into the available pocket space often lacked the capacity to transfer the requisite heat to the recirculating air. To obtain the necessary performance from prior heat exchangers, it was frequently necessary to mechanically induce the hot products of combustion to flow from the combustion chamber to the flue. For that purpose, an inducer in the form of a fan or blower was often installed in the stream of the products of combustion downstream from the combustion chamber. Although the inducers did increase the flow rate of the products of combustion, a serious disadvantage was that the inducer adversely affected the combustion of the fuel. Particularly, the inducer tended to destabilize the burner flame in the combustion chamber and therefore cause a decrease in burner efficiency.

To suit the limited space available, prior heat exchangers were designed unsymmetrically about their combustion chambers. In addition, the ducts were arranged to provide a series path for the flow of the products of combustion from the combustion chamber to the flue. Because of the unsymmetrical and series flow design, the combustion chamber and the various ducts occupied respective portions of the pocket such that recirculating air flowing past the ducts did not flow uniformly past the combustion chamber, and air flowing past the combustion chamber did not flow uniformly past the ducts. The recirculating air that flowed past the combustion chamber was exhausted from the pocket at a higher temperature than the temperature of the air that flowed past the ducts. Similarly, the air that flowed past the ducts adjacent the combustion chamber was exhausted from the pocket at a higher temperature than the air that flowed past the ducts adjacent the flue. The result was that the stream of recirculating air leaving the pocket had a distinct temperature gradient across its cross section. The temperature gradient was not dissipated by continued downstream flowing of the air into the working chamber, that is, the various temperature layers in the stream of air did not mix to form a stream having a uniform temperature. The result was undesirable temperature differences within the working chamber, because some locations therein were hotter than desired and some locations were cooler than desired.

A related disadvantage of the prior heat exchangers in many recirculatory fluid systems was that the recirculating air that flowed past the combustion chambers did not do so effectively. Certain areas of the combustion chambers were not properly scrubbed by the recirculating air, with the result that hot spots were created on the combustion chamber. Those hot spots produced undesirable thermal stresses in the combustion chamber. Further, heat that could have been transferred to the air was wasted instead.

A corollary problem of the space limitations for heat exchangers in recirculatory fluid systems is that the heat exchanger filled a very large percentage of the pocket space. As a result, the flow of recirculating air past the heat exchanger was excessively restricted. Consequently, less than the optimum air flow could occur without the use of an undesirably large fan or blower.

Thus, a need exists for improved heat exchangers for use in confined enclosures.

SUMMARY OF THE INVENTION

In accordance with the present invention, a pocket heat exchanger is provided that has greatly increased efficiency and convenience compared with prior heat exchangers of similar size and applications. This is accomplished by apparatus that includes a duct system arranged symmetrically about a combustion chamber to provide parallel flow paths for hot products of combustion from the combustion chamber to a flue.

The pocket heat exchanger is self-contained as a module that is designed to be easily installed as a unit into a pocket of a recirculatory fluid system. The pocket is connected via suitable passages to a working chamber. Objects in the working chamber are exposed to a recirculating gas that is heated in the pocket by the pocket heat exchanger. The gas circulates continuously through the passages of the recirculatory system to the working chamber and back to the pocket.

The combustion chamber of the pocket heat exchanger is formed as an elongated tube having a longitudinal axis and first and second ends. A support plate is fastened to the combustion chamber first end; the support plate lies perpendicular to the combustion chamber longitudinal axis. A power burner is mounted to the support plate on the side thereof opposite the combustion chamber.

The second end of the combustion chamber supports and opens into an inlet header that constitutes a part of the duct system. Extending between the inlet header and the support plate are one or more primary ducts. On the opposite side of the support plate as the primary ducts is attached a front header. The primary ducts from the inlet header open into the front header. Two or more secondary ducts also open into the front header. The secondary ducts extend from the front header to a back header. The back header opens into the secondary ducts and also into two or more tertiary ducts located between the secondary ducts. The primary, secondary, and tertiary ducts are separated by spaces that form slots through which the recirculating gas flows.

The tertiary ducts open into a flue box that may be located between the back header and the support plate. In that case, the flue box connects with a flue that passes through the stream of recirculating gas returning from the working chamber to the pocket of the recirculatory fluid system. The pocket heat exchanger is then said to have an inside vent.

It is an important aspect of the present invention that the duct system and flue are symmetrical about the combustion chamber. Specifically, the ducts, headers, gas slots, and flue box are arranged symmetrically about a central plane that passes through the combustion chamber longitudinal axis. In addition, the duct system provides parallel flow paths for the products of combustion from the combustion chamber to the flue.

Further in accordance with the present invention, the flue may be located such that it does not pass through the gas stream flowing from the working chamber to the pocket of the recirculatory fluid system. In that case, an exhaust header is attached to the support plate on the side thereof opposite the ducts, and the exhaust header opens into the flue. The tertiary ducts are joined to the support plate and open into the exhaust header. The pocket heat exchanger is then said to have an outside vent. The pocket heat exchanger thus has great flexibility regarding the location of the flue.

As summarized thus far, the present invention is a four-pass heat exchanger. It is a feature of the invention that it can be readily adapted to either a two-pass or a three-pass heat exchanger. For a two-pass heat exchanger, the secondary and tertiary ducts are eliminated. Two or more primary ducts are connected to the inlet header. The primary ducts lead to a flue box located between the inlet header and the support plate, but close to the support plate. Such a pocket heat exchanger has an inside vent. Alternately, the pocket heat exchanger of the present invention can have a two-pass duct system with an outside vent. In that construction, an exhaust header is attached to the support plate on the opposite side thereof as the ducts. The ducts pass through the support plate, to which they are welded or otherwise joined, and open into the exhaust header.

For a three-pass pocket heat exchanger, an inlet header and a front header are employed. At least one primary duct opens into and extends between the inlet header and the front header, which is attached to the support plate on the side thereof opposite the ducts. From the front header, at least two secondary ducts lead to a fluebox near the inlet header. With a three-pass duct system, an inside vent is required.

Like the four-pass pocket heat exchanger of the present invention, both the three-pass and the two-pass pocket heat exchangers have respective duct systems that are symmetrical about a central plane passing through the longitudinal axis of the combustion chamber. Further, both the three-pass and the two-pass pocket heat exchangers provide parallel flow paths for the products of combustion from the combustion chamber to the flue.

The pocket heat exchanger is installed as a modular unit in the pocket of a recirculatory fluid system in a quick and simple manner. The pocket heat exchanger is merely lifted with a forklift truck or the like and inserted into the pocket. Conventional fasteners are used to mount the support plate to appropriate flanges in the framework of the recirculatory fluid system. There is no contact between the pocket heat exchanger and the recirculatory system framework other than between the heat exchanger support plate and some flanges on the recirculatory system. One or two covers cooperate with the support plate to cover the entire pocket opening and form one of the walls of the pocket. The power burner and its controls are located in a separate compartment outside of the pocket, where they are easily accessible for servicing.

The pocket heat exchanger of the present invention is designed with an external envelope that carefully suits the particular pocket of the recirculatory fluid system with which it is used. As part of the design features of the pocket heat exchanger, the spacings between the ducts and headers thereof and the walls of the recirculatory fluid system pocket are carefully controlled. Those spacings serve as auxiliary slots for a portion of the recirculating gas flowing through the pocket past the pocket heat exchanger.

In operation, the power burner is ignited to produce a flame within the combustion chamber. The hot products of combustion are transported from the combustion chamber to the inlet header. From there, the hot products of combustion pass in parallel fashion through the primary ducts into the two front headers, through the secondary ducts to the back header, and through the tertiary ducts to the flue. Simultaneously, recirculating gas is drawn through the duct system slots and the auxiliary slots and past the combustion chamber. Because of the symmetrical design of the pocket heat exchanger, all the recirculating gas flows around the combustion chamber, the hottest portion of the pocket heat exchanger. Consequently, the temperature gradient across the recirculating gas stream flowing from the pocket is much smaller than with prior heat exchangers.

To assure proper flow of all the recirculating gas past the combustion chamber, a shroud is mounted inside the recirculatory fluid system pocket. The shroud directs all the recirculating gas around the combustion chamber in a manner that scrubs a maximum amount of the combustion chamber periphery. The results are a maximum transfer of heat from the combustion chamber to the recirculating gas and a stream of heated gas that has a practically uniform temperature across its cross section.

The pocket heat exchanger of the present invention thus greatly improves the performance of recirculatory fluid systems by heating a stream of recirculating gas to have a minimal temperature gradient across its cross section. The duct system and venting of the pocket heat exchanger are flexible to suit different application requirements, and the pocket heat exchanger provides high efficiency and high heat transfer rates in a small space without the use of inducers for the products of combustion.

Other advantages, benefits, and features of the present invention will become apparent to those skilled in the art upon reading the detailed description of the invention.

DETAILED DESCRIPTION OF THE PREFERRED EMBODIMENT

Figure 1:
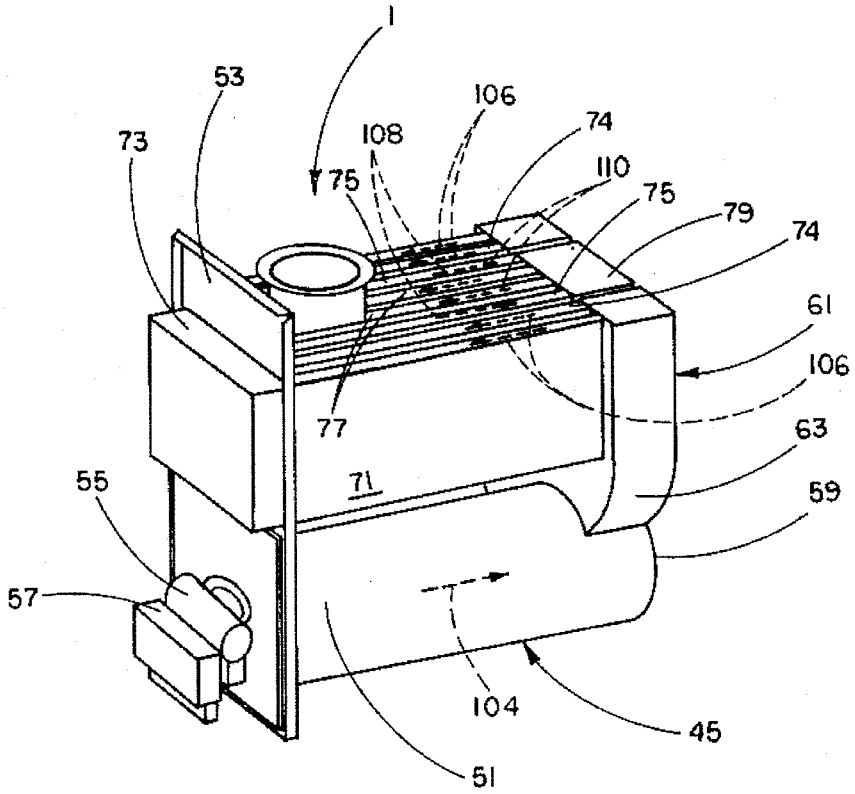
FIG. 1 is a perspective view of a four-pass pocket heat exchanger according to the present invention that has an inside vent.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–5, a pocket heat exchanger 1 is illustrated that includes the present invention. The pocket heat exchanger 1 is particularly useful for supplying a heated gas in a recirculatory process system, typically represented by reference numeral 3. However, it will be understood that the invention is not limited to closed loop process applications.

For illustrative purposes, the recirculatory process system 3 is shown as an oven 5 for baking food products such as loaves of bread 7 or the like. The particular oven 5 shown has a baking chamber 9 in which the loaves 7 are placed in well known manner. The baking chamber 9 has a top wall 11, back wall 13, bottom wall 15, and two side walls 17 and 18. A door 19 provides access to the baking chamber. The walls 17 and 18, as well as the door 19, are normally insulated.

Above the top wall 11 of the baking chamber 9 is an oven top wall 21. The baking chamber top wall and the oven top wall 21 cooperate with the side walls 17 and 18 to form a top passage 22. Below the bottom wall 15 of the baking chamber is an oven bottom wall 23. The baking chamber bottom wall and the oven bottom wall 23 cooperate with the side walls 17 and 18 to form a bottom passage 27. Openings 29 in the baking chamber top wall extend between the baking chamber and the top passage 22. Similar openings 31 in the baking chamber bottom wall extend between the baking chamber and the bottom passage 27.

A vertical oven back wall 25 is parallel to the baking chamber back wall 13. The oven back wall 25 has a narrow vertical flange 33 that extends part way between the oven top and bottom walls 21 and 23, respectively. A similar flange 35 is formed on the baking chamber back wall 13. The flanges 33 and 35, portion 36 of the oven back wall, and portions of the baking chamber back wall and side wall 17 and oven top wall 21 define a pocket 37. Ordinarily, the size of the pocket 37 is very limited. The pocket connects with the top and bottom passages 22 and 27, respectively. A blower 39 is located in the pocket near the oven bottom wall 23. The pocket and the oven bottom passage are connected through the blower 39.

A front compartment 41 of the oven 5 is defined by the flanges 33 and 35 and by portions of the oven top wall 21, oven bottom wall 23, oven back wall 25, and back wall 13 of the baking chamber 9. The front compartment 41 is closeable by a cover 43.

In accordance with the present invention, the pocket heat exchanger 1 efficiently provides adequate heated process air to the baking chamber 9 while fitting within the confines of the oven pocket 37. For that purpose, pocket heat exchanger is designed with a tubular combustion chamber 45, a duct system 49, and a flue 95. The combustion chamber 45 has a longitudinal axis 47. A central plane 50, which for illustrative purposes is shown as being vertical, passes through the combustion chamber longitudinal axis 47.

The front end 51 of the combustion chamber 45 is open and is fastened to a vertical support plate 53. Mounted on the opposite side of the support plate 53 as the combustion chamber are a conventional power burner 55 and attendant controls 57. The back end 59 of the combustion chamber is closed. Supported on the combustion chamber at its back end 59 is a vertically oriented U-shaped header 61. The base portion 63 of the U-shaped header 61 opens into the combustion chamber through an opening 65. The legs 67 of the U-shaped header are symmetrical about the central plane 50.

In the illustrated construction, the front wall 68 of each leg 67 of the U-shaped header 61 is formed with two narrow elongated openings 69 and 70. Each opening 69 opens into a respective primary duct 71 that is secured, as by welding, to the U-shaped header front wall 68. Each opening 70 opens into a similar respective primary duct 74. The primary ducts 71 and 74 extend from the U-shaped header to the support plate 53, to which they are joined. There is an air slot 72 between each pair of adjacent primary ducts 71 and 74. Attached to the support plate opposite the primary ducts is a front header 73. There are openings through the support plate, not shown, in alignment with the openings 69 and 70 in the U-shaped header. Consequently, the interiors of the primary ducts open into the front header 73.

Joined to the support plate 53 between the primary ducts 74 are a pair of secondary ducts 75. Openings, not shown, through the support plate enable the secondary ducts 75 to communicate with the interior of the front header 73. The secondary ducts 75 extend from the support plate to a back header 79, to which the secondary ducts are secured. Preferably, the back header 79 is located between the legs 67 of the U-shaped header 61. Openings 81 in the back header 79 enable the secondary ducts 75 to communicate with the interior of the back header. Like the primary ducts 71 and 74, the secondary ducts 75 are symmetrical about the central plane 50. There is an air slot 85 between each pair of adjacent ducts 74 and 75.

Also secured to the back header 79 are a pair of tertiary ducts 77. Openings 83 in the back header enable the tertiary ducts 77 to communicate with the interior of the back header. The tertiary ducts are symmetrical about the central plane 50. There is an air slot 87 between each pair of adjacent ducts 75 and 77. There is another air slot 89 between the two tertiary ducts 77.

The tertiary ducts 77 do not extend to the support plate 53. Rather, the tertiary ducts terminate at and are secured, as by welding, to a flue box 91 located between the secondary ducts 75 and close to the support plate 53. The flue box 91 has an open top that leads into a flanged flue fitting 93. A flue 95 connects to the flue fitting 93.

The pocket heat exchanger 1 is used by installing it as a module in the heating enclosure of a recirculatory process system, such as in the pocket 37 of the oven 5. Installation is achieved by lifting the pocket heat exchanger as a unit with a fork lift truck or the like and inserting it through the oven front compartment 41 and into the pocket. Conventional fasteners, not shown, are employed to mount the pocket heat exchanger support plate 53 to the flanges 33 and 35 of the oven. Suitable covers, not shown, extend between any open areas between the bottom and top of the support plate, the oven bottom wall 23, the oven top wall 21, the oven back wall 25, and the back wall 13 of the baking chamber 9. In that manner, the pocket is completely sealed from the front compartment 41.

The pocket heat exchanger 1 is further designed such that it cooperates with the walls that form the pocket 37 of the oven 5 to create auxiliary air slots of controlled size. Specifically, one of the primary ducts 71 is located relatively close to the oven back wall 25 and cooperates therewith to form an auxiliary air slot 96. Similarly, the other primary duct 71 cooperates with the back wall 13 of the baking chamber 9 to form another auxiliary air slot 98. Finally, the U-shaped header 61 and the back header 79 cooperate with the oven side wall 17 to form a third auxiliary air slot 100.

In operation, the power burner 55 of the pocket heat exchanger 1 is ignited to burn fuel such as natural gas and to create a long flame within the combustion chamber 45. The hot products of combustion are transported from the combustion chamber through the U-shaped header 61, as represented by arrows 104 in FIGS. 1 and 4, to the primary ducts 71 and 74. The primary ducts conduct the products of combustion to the front header 73, arrows 106 (FIG. 1). From the front header, the products of combustion are conducted by the secondary ducts 75 to the back header 79, arrows 108. From the back header 79, the products of combustion are conducted through the tertiary ducts 77 to the flue box 91, arrows 110, and out the flue 95. Because the products of combustion flow in four different directions between the combustion chamber and the flue, the pocket heat exchanger 1 is called a four-pass heat exchanger.

Simultaneously with the flow of the products of combustion through the pocket heat exchanger 1, the blower 39 operates to draw process air through the air slots 72, 85, 87, and 89, of the duct system 49 and through the auxiliary air slots 96, 98, and 100. The flowing process air is heated by contact with the ducts 71, 74, 75, and 77 that conduct the hot products of combustion from the combustion chamber 45 to the flue 95. The process air flowing through the air slots 85 flows over the bridge portion 102 of the U-shaped header 61. That portion of the process air prevents any hot spots and attendant thermal stresses from occurring at the U-shaped header bridge portion 102. After flowing through the air slots, the entire stream of process air flows around the combustion chamber 45, thereby picking up additional heat. The heated process air, represented by arrow 97, is forced by the blower 39 into the bottom passage 27 in the oven 5. From the passage 27, the hot process air, represented by arrows 99, flows through the openings 31 in the bottom wall 15 of the baking chamber 9 and into the baking chamber. The hot process air heats the loaves 7 or the like and cools. The cooled air, represented by arrows 101, flows out the openings 29 in the baking chamber top wall 11 to the oven upper passage 22. From the upper passage, the process air returns to the pocket 37 and again passes through the air slots 72, B5, 87, 89, 96, 98, and 100 to be reheated. A temperature control schematically represented at reference numeral 103 leads, as by wire 105, to the burner control 57 for regulating the burner 55 and thus the process air temperature. In that manner, the pocket heat exchanger 1 provides heated process air on a continuous basis for heating the loaves 7 or the like in the baking chamber.

As described, the process air flow 97, 99, and 101 is in a counterflow direction, as that type of flow produces the highest efficiency and is therefore preferred for the recirculatory process system 3. However, it will be appreciated that the flow of the process air can be reversed to parallel flow, if desired.

The symmetrical design of the duct system 49 of the pocket heat exchanger about the central plane 50 is of paramount importance. The symmetrical design enables the stream of returning process air 101 to be heated to a practically uniform temperature across its cross section, i.e., the temperature gradient across the cross section of the heated process air stream is practically non-existent. As a consequence, the hot process air 97 and 99 enters and flows through the chamber 9 with a uniform temperature. The result, in the illustrative example of the oven 5, is uniform baking of the loaves 7 of bread or other objects heated by the process air in the baking chamber 9.

An outstanding advantage of the design of the pocket heat exchanger 1 is that a gravity vent is highly preferred for successful operation: no inducer is needed to draw the products of combustion from the combustion chamber 45, through the duct system 49, and to the flue 95. As a result, the burner flame in the combustion chamber need not be disturbed by an inducer. The power burner 55 can thus operate at varying firing rates with maximum efficiency.

The symmetrical design of the duct system 49 about the central plane 50 results in the further advantage of producing balanced expansion of the various components of the pocket heat exchanger 1 during operation. Consequently, the thermal and mechanical stresses caused by unequal heating of various components are minimized. In addition, the design of the combustion chamber 45 is dimensionally compatible with different commercially available power burners 55. Accordingly, the pocket heat exchanger can be readily fit with any of a number of burners so as to suit the particular recirculatory process system 3 with which the pocket heat exchanger is to be used. To provide further convenience to the pocket heat exchanger, the power burner 55 and its controls 57 can be serviced via access thereto from the front compartment 41, which is sealed from the pocket 37. Consequently, the pocket heat exchanger 1 itself need not be disturbed in any manner when service is required to the burner or controls.

Figure 2:
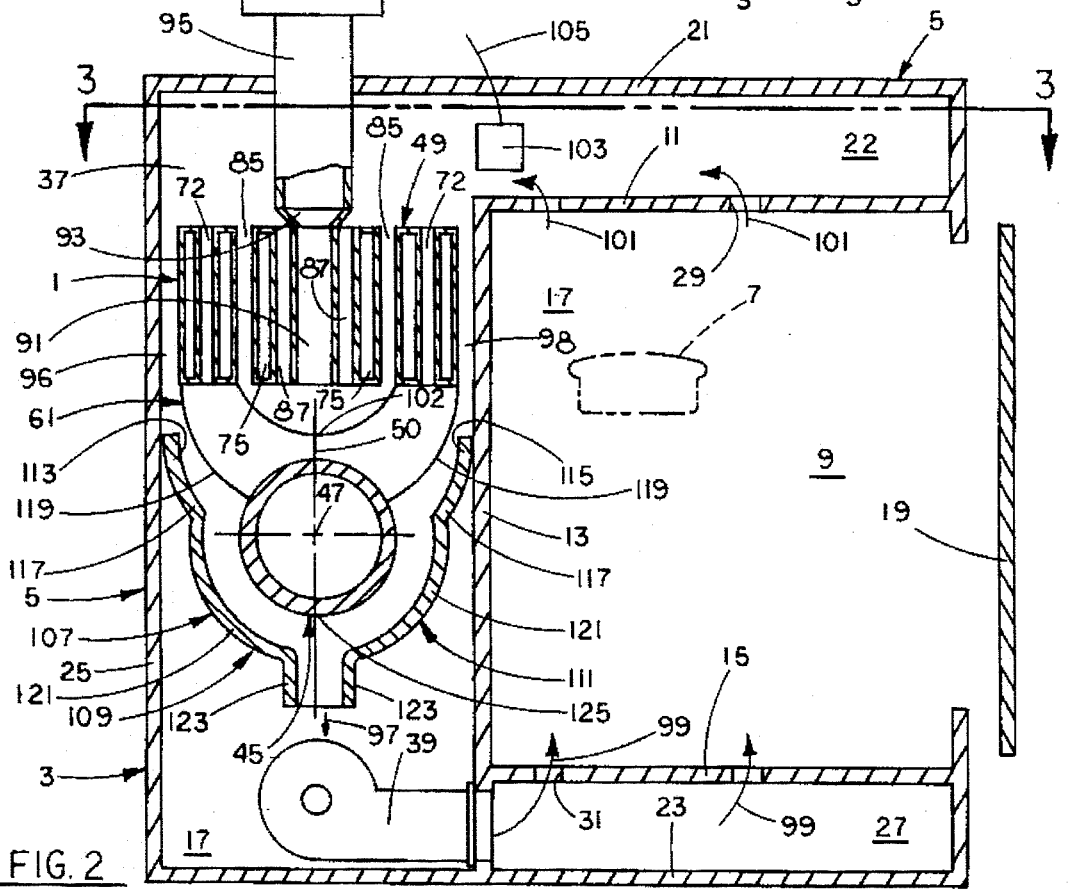
FIG. 2 is a simplified vertical cross sectional view taken along line 2—2 of FIG. 3 and showing the pocket heat exchanger installed in a typical recirculatory fluid system.
Figure 4:
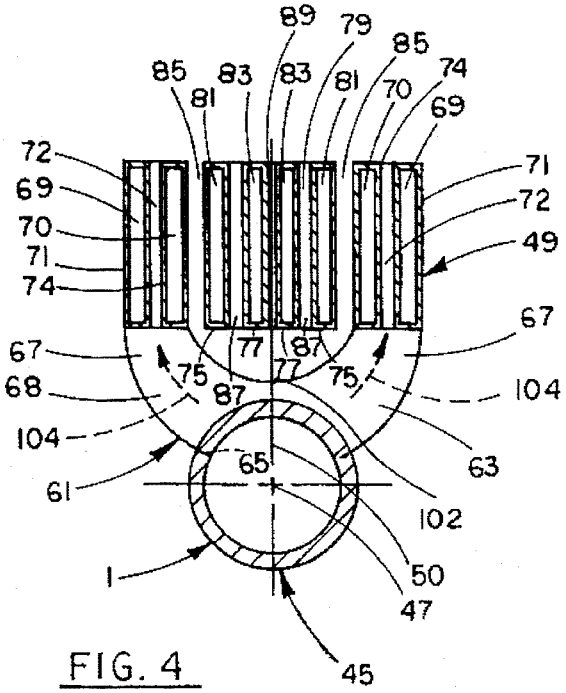
FIG. 4 is an enlarged cross sectional view taken along line 4—4 of FIG. 3.
Figure 5:
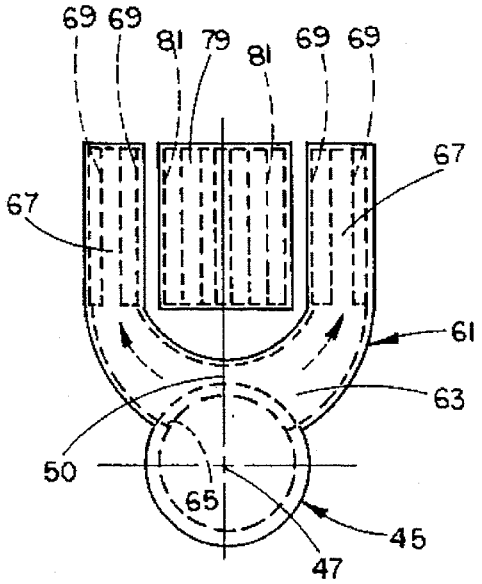
FIG. 5 is a view taken along line 5—5 of FIG. 3.

To further assure a uniform temperature distribution across the heated process air stream 97, the present invention includes a shroud 107. As best shown in FIG. 2, the shroud 107 comprises two elongated panels 109 and 111. The panels 109 and 111 extend for the full length of the pocket 37 between the oven side wall 17 and the vertical flanges 33 and 35. The panels 109 and 111 have respective upper ends 113 and 115. The upper end 113 of the panel 109 is fastened to the back wall 25 of the oven 5, and the upper end 115 of the panel 111 is fastened to the back wall 15 of the baking chamber 9. The panels are arranged symmetrically about the central plane 50. In the particular construction illustrated, the panels have respective first lobes 117 that are spaced from and are generally parallel to the side surfaces 119 of the U-shaped header 61. A second lobe 121 of each panel is spaced from and generally parallel to the circumference of the combustion chamber 45. Each shroud panel also has a generally vertical leg portion 123. The two leg portions 123 cooperate with each other to form an air outlet passage of controlled width for the process air 97 flowing past the pocket heat exchanger 1.

The shroud 107 serves primarily to guide the process air around the combustion chamber 45 of the pocket heat exchanger 1 in as complete a manner as possible. Particularly, the shroud enables the process air to scrub the downstream or lower area 125 of the combustion chamber. The result is a very efficient transfer of heat from the pocket heat exchanger to the process air 97. At the same time, the flowing process air prevents any hot spots from forming on the combustion chamber, especially in the region of its downstream area 125.

Figure 6:
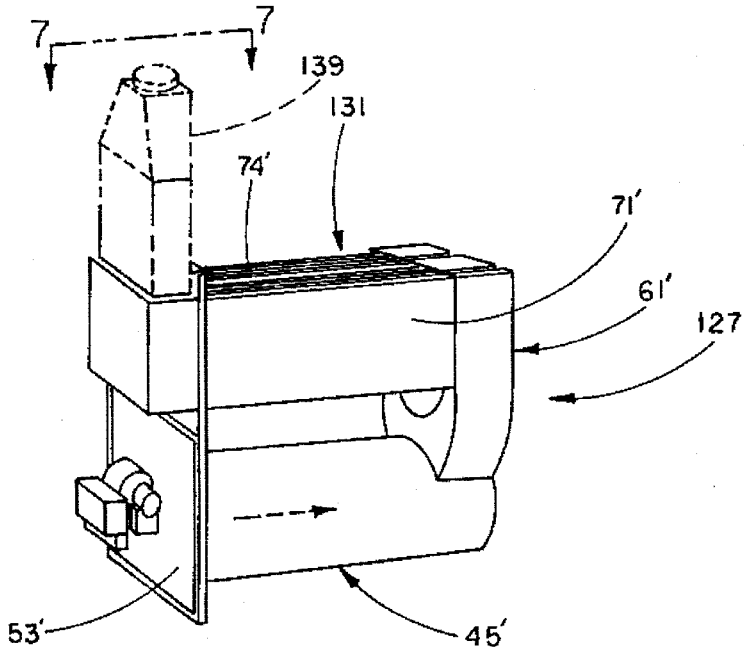
FIG. 6 is a view similar to FIG. 1, but showing a four-pass pocket heat exchanger having an outside vent.
Figure 3:
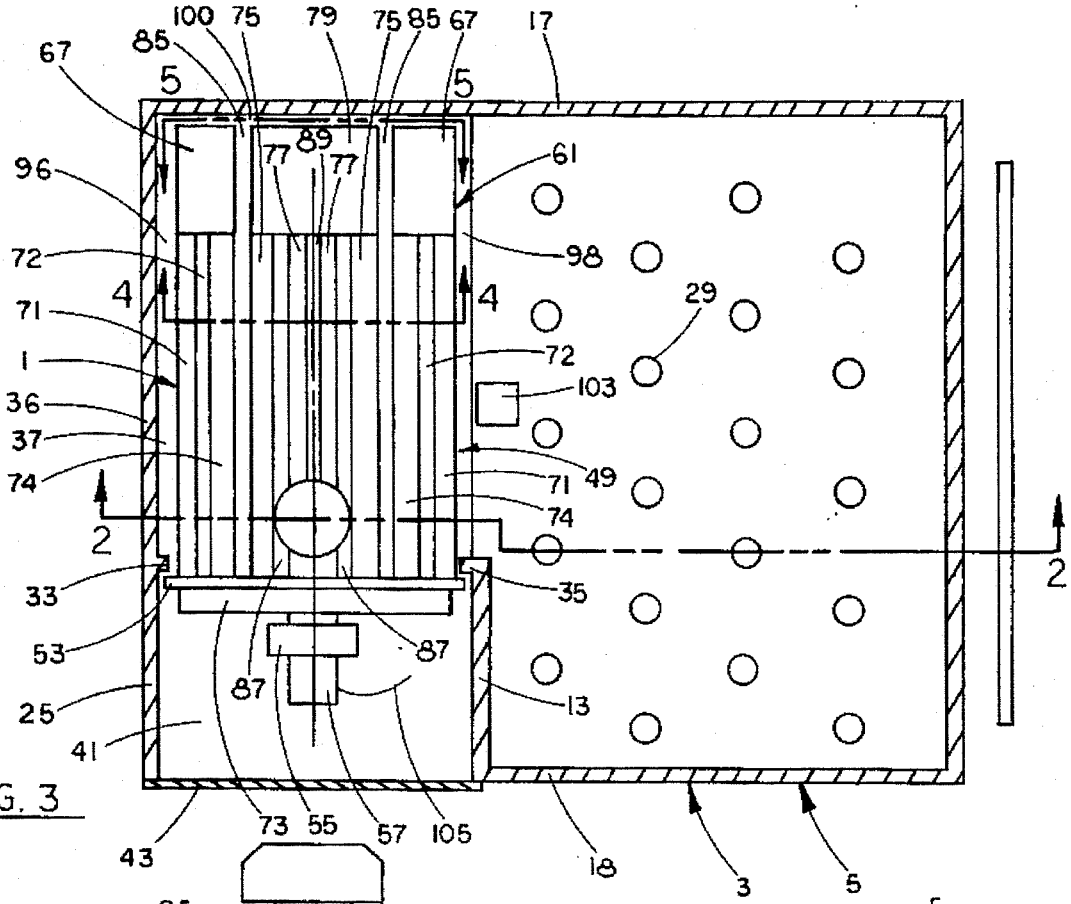
FIG. 3 is a cross sectional view taken along line 3—3 of FIG. 2.
Figure 7:
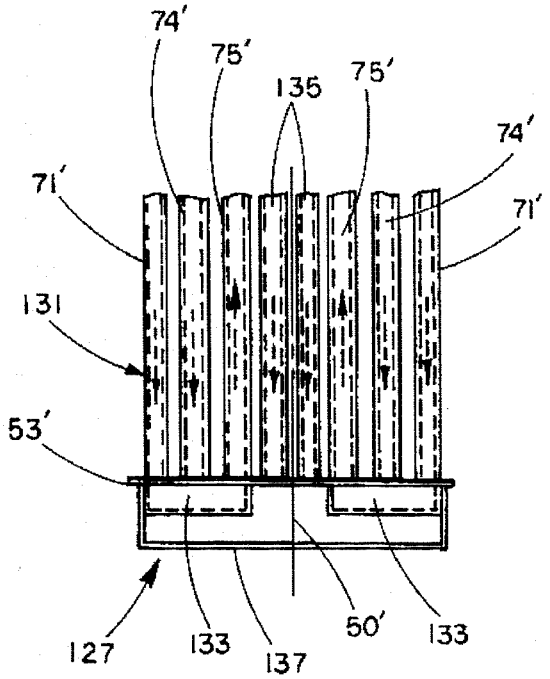
FIG. 7 is a partial view taken along line 7—7 of FIG. 6.

It will be noted from FIGS. 2 and 3 that the flue 95 passes through the process air stream 101 returning to the pocket 37. Such a flue design is termed an inside vent. It is a feature of the present invention that the pocket heat exchanger has the flexibility to locate the flue outside of the process air stream 101. Turning to FIGS. 6 and 7, a four-pass pocket heat exchanger 127 is shown that has an outside vent. The pocket heat exchanger 127 has a support plate 53', combustion chamber 45', and U-shaped header 61' that are substantially similar to the support plate 53, combustion chamber 45, and U-shaped header 61, respectively, described above in connection with the pocket heat exchanger 1. The pocket heat exchanger 127 further has a duct system 131 that is generally similar to the duct system 49 of the pocket heat exchanger 1. The duct system 131 of the pocket heat exchanger 127 is symmetrical about a central plane 50' passing through the longitudinal axis of the combustion chamber 45'. The duct system 131 as illustrated includes four primary ducts 71' and 74' that are substantially similar to the respective primary ducts 71 and 74 of the pocket heat exchanger 1. The primary ducts 71' and 74' extend between the U-shaped header 61' and the support plate 53' and open into front headers 133 through suitable openings in the support plate 53'. Secondary ducts 75' similar to the secondary ducts 75 of the pocket heat exchanger 1, also communicate with the corresponding front headers 133. The secondary ducts 75' extend to a back header, not shown, that is substantially similar to the back header 79 of the pocket heat exchanger 1.

The duct system 131 has a pair of tertiary ducts 135 located between the secondary ducts 75'. The tertiary ducts 135 extend from the back header to the support plate 53', to which they are joined. An exhaust header 137 is attached to the support plate 53' on the opposite side thereof as the ducts. The exhaust header 137 may be constructed to surround the front headers 133. The tertiary ducts 135 communicate with the exhaust header 137 through suitable openings in the support plate 53'. The exhaust header has an open top to which a flue 139 is connected. It is thus seen that when the pocket heat exchanger 127 is inserted into the pocket 37 of the oven 5 (FIGS. 2 and 3), the flue 139 is located in the front compartment 41 outside of the pocket and thus outside of the process air stream 101. The flexibility of the pocket heat exchanger design that enables it to suit different venting requirements is an important benefit.

Figure 8:
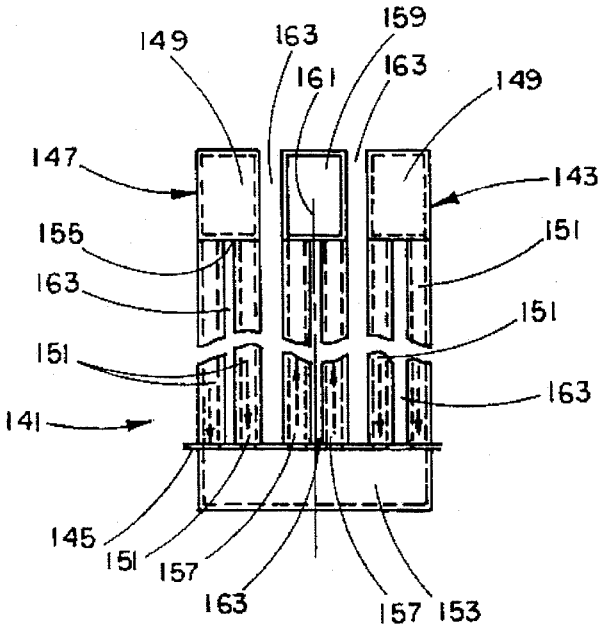
FIG. 8 is a partial top view of a pocket heat exchanger with a three-pass duct system.

Further in accordance with the present invention, the pocket heat exchanger can be configured with two-pass or three-pass duct systems as well as the four-pass duct systems 49 and 131 of FIGS. 1–7. Looking at FIG. 8, a partial top view of a pocket heat exchanger 141 having a three-pass duct system 143 is shown. The pocket heat exchanger 141 has a vertically oriented support plate 145 and a U-shaped header 147, of which only the top ends of the two legs 149 are shown. Extending between and secured to the legs 149 of the U-shaped header 147 and the support plate 145 are four primary ducts 151. Attached to the support plate 145 on the opposite side thereof as the primary ducts 151 is a front header 153. The primary ducts open into the U-shaped header and the front header 153 through suitable openings in the front wall 155 of the U-shaped header and in the support plate, respectively.

Also secured to the support plate 145 between the primary ducts 151 are a pair of secondary ducts 157. The secondary ducts 157 open into the front header 153 through suitable openings in the support plate. Located between the two legs 149 of the U-shaped header 147 is a flue box 159 to which the secondary ducts are secured and into which they open. The flue box 159 has an open top to which a flue, not shown, is connected. The entire duct system 143 is symmetrical about a central plane 161 that passes through the longitudinal axis of the combustion chamber, not shown, of the pocket heat exchanger 141. For maximum convenience, the three-pass pocket heat exchanger 141 is normally constructed only with the inside vent shown in FIG. 8.

The operation of the pocket heat exchanger 141 with the three-pass duct system 143 is very similar to the operation of the four-pass pocket heat exchangers discussed previously. Hot products of combustion are transported from the combustion chamber to the two legs 149 of the U-shaped header 147, through the primary ducts 151 to the front header 153, and through the secondary ducts 157 to the flue box 159. At the same time, process air flows through the air slots 163 between the various ducts and through auxiliary air slots between the duct system 143 and the pocket walls of the recirculatory process system. The three-pass pocket heat exchanger operates with nearly the same efficiency and convenience as the four-pass pocket heat exchangers 1 and 127 described previously.

Figure 10:
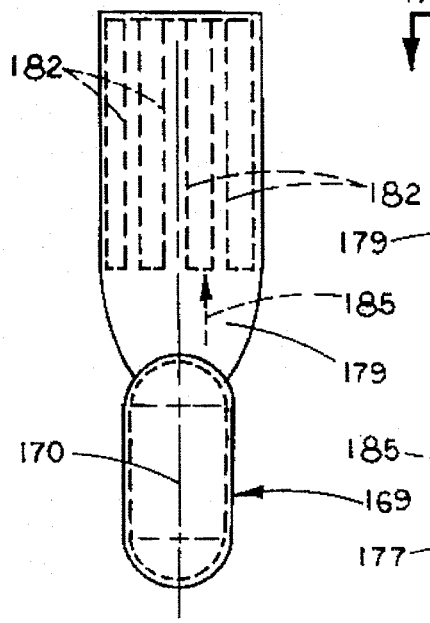
FIG. 10 is an end view of FIG- 9.
Figure 9:
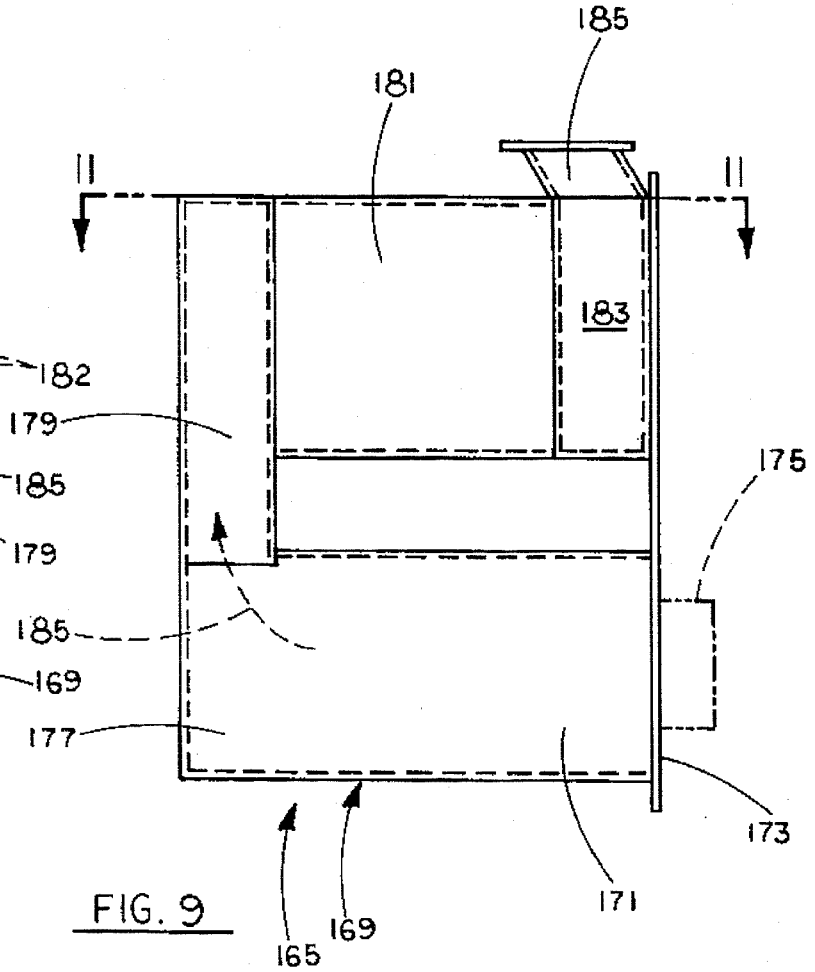
FIG. 9 is a side view of a pocket heat exchanger having a two-pass duct system and an inside vent.
Figure 11:
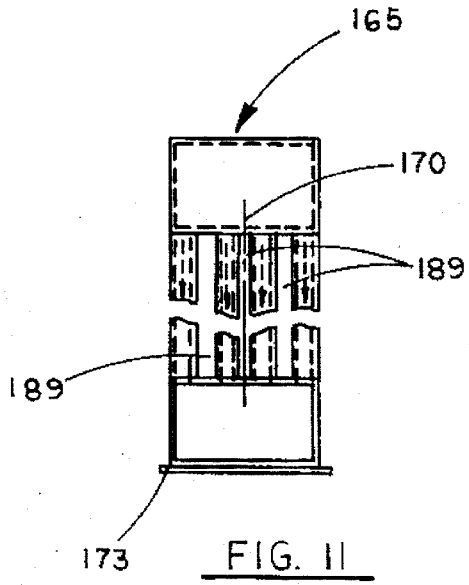
FIG. 11 is a view taken along line 11—11 of FIG. 9 and rotated 90 degrees counterclockwise.
Figure 12:
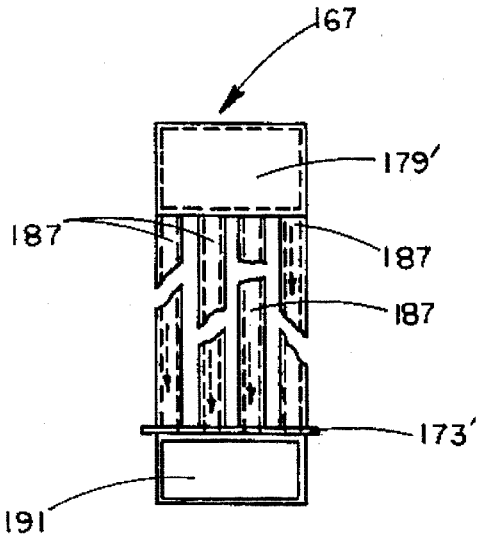
FIG. 12 is a view similar to FIG. 11, but showing a two-pass pocket heat exchanger with an outside vent.

The flexibility of the present invention is further demonstrated by the two-pass pocket heat exchanger 165 depicted in FIGS. 9–11 and by the two-pass pocket heat exchanger 1G7 depicted in FIG. 12. In the preferred embodiment, the two-pass pocket heat exchanger 165 has an obround combustion chamber 169. The combustion chamber 169 defines a vertical central plane 170. The combustion chamber front end 171 is fastened to a vertical support plate 173. A power burner and its controls, represented by phantom lines 175, are mounted to the support plate 173 opposite the combustion chamber 169.

Supported on and opening into the back end 177 of the combustion chamber 169 is a vertically oriented back header 179. Four ducts 181 are shown secured to the back header 179 above the combustion chamber. The ducts 181, as well as the back header, are symmetrically located about the vertical plane 170. The ducts open into the back header through suitable openings 182 therein. The ducts 181 extend toward the support plate 173, and they terminate at and are welded to a flue box 183 that is located between the back header and the support plate. The flue box 183 is open at the top, and it leads to a flue 185. The pocket heat exchanger 165 thus has an inside vent.

The installation and operation of the two-pass pocket heat exchanger 165 is very similar to that described above in conjunction with the four-pass pocket heat exchangers 1 and 127 and the three-pass pocket heat exchanger 141. Hot products of combustion produced in the combustion chamber 169 are transported through the back header 179, as represented by arrows 185, to the ducts 181. From the ducts, the products of combustion flow to the flue box 183 and then out the flue 185. Process air flows through the air slots 189 between the ducts to be heated by contact with the ducts and the combustion chamber. The symmetrical design and gravity vent of the two-pass pocket heat exchanger 165 result in efficiencies of operation, installation, and service beyond those previously available in similar size heat exchangers.

The two-pass pocket heat exchanger 167 of FIG. 12 is very similar to the pocket heat exchanger 165 of FIGS. 9–11.

However, the pocket heat exchanger 167 has an outside vent. The pocket heat exchanger 167 has a back header 179', to which ducts 187 are secured and open into. The ducts 187 extend to and are joined to a vertically oriented support plate 173'. An exhaust header 191 is attached to the support plate 173' opposite the ducts 187. Openings through the support plate 173' provide communication between the ducts 187 and the exhaust header 191. A flue, not shown, is connected to the exhaust header to exhaust the products of combustion.

As an example of a typical pocket heat exchanger according to the present invention, a representative four-pass pocket heat exchanger 1 of FIG. 1–5 has the following dimensions. The combustion chamber 45 is approximately 42 inches long and has an inner diameter of approximately 14.5 inches. The support plate 53 has a height of approximately 46 inches and a width of approximately 22 inches. The ducts 71, 74, 75, and 77 have respective external heights of approximately 16 inches and widths of approximately 1.63 inches. The width of the air slots 72, 85, 87, and 89 is approximately 1 inch. The overall width of the duct system 49 is about 20 inches. A pocket heat exchanger with the foregoing dimensions burning natural gas can produce and transfer 320,000 BTUs per hour to process air flowing at the rate of 3,700 cubic feet per minute. That performance, especially in view of the practically uniform temperature distribution of the heated process air stream, is outstanding compared with prior heat exchangers used in similar applications.

In summary, the results and advantages of recirculatory process systems 3 can now be more fully realized. The pocket heat exchangers 1, 127, 141, 165, and 167 of the present invention provide very efficient, convenient, and compact sources of heated process air for the recirculatory process systems. This desirable result comes from designing each pocket heat exchanger with a multi-pass parallel flow duct system that is arranged symmetrically about a plane passing through the longitudinal axis of the combustion chamber. The duct system of each pocket heat exchanger defines air slots through which process air passes, and the process air also flows past and scrubs the combustion chamber. The value of the invention is further enhanced by its ability to suit particular applications by optimally providing either inside or outside vents.

It will also be recognized that in addition to its superior performance, the pocket heat exchanger of the present invention is constructed so as to significantly reduce its size compared to traditional heat exchangers having the same capacity and used in similar applications. Moreover, since all components requiring servicing are located external to the pocket 37 of a recirculatory process system 3 in which a pocket heat exchanger is typically installed, maintenance of the pocket heat exchanger is greatly simplified.

Thus, it is apparent that there has been provided, in accordance with the invention, a pocket heat exchanger that fully satisfies the aims and advantages set forth above. While the invention has been described primarily in conjunction with specific embodiments thereof especially useful with recirculatory process systems, it is evident that many alternatives, modifications, and variations will be apparent to those skilled in the art in light of the foregoing description. For example, the pocket heat exchanger is also eminently suitable for climate control and other non-process recirculatory applications. Accordingly, it is intended to embrace all such alternatives, modifications, and variations as fall within the spirit and broad scope of the appended claims.

I claim:

1. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion; and f. duct means arranged symmetrically about the plane for conducting products of combustion from the first header means to the flue means along multiple paths that lie substantially completely in directions parallel to the longitudinal axis.

2. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion; and f. duct means arranged symmetrically about the plane for conducting products of combustion in parallel paths from the first header means to the flue means, wherein the first header means is fabricated as a U-shaped header having a base portion that opens into the combustion chamber back end and a pair of legs that are secured to and open into the duct means.

3. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion; and f. duct means arranged symmetrically about the plane for conducting products of combustion in parallel paths from the first header means to the flue means, wherein the duct means comprises:

i. primary duct means arranged symmetrically about the plane for conducting products of combustion in parallel paths from the first header means;

ii. second header means for receiving products of combustion from the primary duct means; and iii. secondary duct means arranged symmetrically about the plane for conducting products of combustion in parallel paths from the second header means to the flue means.

4. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber, wherein the first header means comprises a generally U-shaped header having a base portion that is supported by and opens into the combustion chamber and a pair of legs;

e. flue means arranged symmetrically about the plane for venting the products of combustion, wherein the flue means comprises a flue box located between the legs of the U-shaped header; and f. duct means arranged symmetrically about the plane for conducting products of combustion in parallel paths from the first header means to the flue means, wherein the duct means comprises:

i. primary duct means arranged symmetrically about the plane for conducting products of combustion in parallel paths from the first header means;

ii. second header means for receiving products of combustion from the primary duct means; and iii. secondary duct means arranged symmetrically about the plane for conducting products of combustion in parallel paths from the second header means to the flue means, wherein the secondary duct means extends between and opens into the second header means and the flue box.

5. The pocket heat exchanger of claim 4 wherein:

a. the primary duct means comprises at least two primary ducts arranged in parallel symmetrically about the plane and extending between and opening into the U-shaped header and the second header means; and b. the secondary duct means comprises at least two secondary ducts arranged in parallel symmetrically about the plane and extending between and opening into the second header means and the flue box.

6. The pocket heat exchanger of claim 5 wherein there are at least four primary ducts arranged in parallel symmetrically about the plane and extending between and opening into the legs of the U-shaped header and the second header means.

7. The pocket heat exchanger of claim 5 wherein air slots of predetermined width are located between respective adjacent primary and secondary ducts and between the flue box and the legs of the U-shaped header.

8. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion; and f. duct means arranged symmetrically about the plane for conducting products of combustion in parallel paths from the first header means to the flue means, wherein the duct means comprises:

i. primary duct means arranged symmetrically about the plane for conducting products of combustion in parallel paths from the first header means;

ii. second header means for receiving products of combustion from the primary duct means;

iii. secondary duct means arranged symmetrically about the plane for conducting products of combustion in parallel paths from the second header means;

iv. third header means for receiving products of combustion from the secondary duct means; and v. tertiary duct means arranged symmetrically about the plane for conducting products of combustion in parallel paths from the third header means to the flue means.

9. The pocket heat exchanger of claim 8 wherein:

a. the first header means comprises a generally U-shaped header having a base portion that is supported on and opens into the combustion chamber and a pair of legs;

b. the second header means comprises a front header attached to the support plate;

c. the third header means comprises a back header located between the legs of the U-shaped header; and d. the flue means comprises a flue box located between the front header and the back header.

10. The pocket heat exchanger of claim 9 wherein:

a. the primary duct means comprises at least two primary ducts arranged in parallel symmetrically about the plane and extending between and opening into the U-shaped header and the front header;

b. the secondary duct means comprises at least two secondary ducts arranged in parallel symmetrically about the plane and extending between and opening into the front header and the back header; and c. the tertiary duct means comprises at least two tertiary ducts arranged in parallel symmetrically about the plane and extending between and opening into the back header and the flue box.

11. The pocket heat exchanger of claim 10 wherein there are at least four primary ducts extending between and opening into the legs of the U-shaped header and the front header.

12. The pocket heat exchanger of claim 10 wherein:

a. the primary, secondary, and tertiary ducts cooperate to define a plurality of air slots; and b. the back header cooperates with the legs of the U-shaped header to define a plurality of air slots.

13. The pocket heat exchanger of claim 8 wherein:

a. the first header means comprises a generally U-shaped header having a base portion and is supported on and opens into the combustion chamber and a pair of legs;

b. the second header means comprises a front header attached to the support plate;

c. the third header means comprises a back header located between the legs of the U-shaped header; and d. the flue means comprises an exhaust header attached to the support plate on the opposite side thereof as the combustion chamber.

14. The pocket heat exchanger of claim 13 wherein:

a. the primary duct means comprises at least two primary ducts arranged in parallel symmetrically about the plane and extending between and opening into the U-shaped header and the front header;

b. the secondary duct means comprises at least two secondary ducts arranged in parallel symmetrically about the plane and extending between and opening into the front and back headers; and c. the tertiary duct means comprises at least two tertiary ducts arranged in parallel symmetrically about the plane and extending between and opening into the back header and into the exhaust header.

15. The pocket heat exchanger of claim 14 wherein there are at least four primary ducts extending between and opening into the legs of the U-shaped header and the front header.

16. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion, wherein the flue means comprises a flue box attached to the support plate and located between the support plate and the first header means; and f. duct means arranged symmetrically about the plane for conducting products of combustion in parallel paths from the first header means to the flue means, wherein the duct means comprises at least two spaced apart ducts arranged in parallel symmetrically about the plane and extending between and opening into the first header means and the flue box, respective adjacent ducts defining air slots of predetermined width therebetween.

17. A pocket heat exchanger comprising:

a. an elongated combustion chamber having front and back ends and defining a longitudinal axis and a plane that passes through the longitudinal axis;

b. a generally planar support plate fastened to the combustion chamber front end and lying in a plane generally perpendicular to the combustion chamber longitudinal axis;

c. burner means mounted to the support plate for producing hot products of combustion in the combustion chamber;

d. first header means arranged symmetrically about the plane for transporting hot products of combustion from the combustion chamber;

e. flue means arranged symmetrically about the plane for venting the products of combustion, wherein the flue means comprises an exhaust header attached to the support plate on the opposite side thereof as the combustion chamber; and f. duct means arranged symmetrically about the plane for conducting products of combustion in parallel paths from the first header means to the flue means, wherein the duct means comprises at least two spaced apart ducts arranged in parallel symmetrical fashion about the plane and extending between and opening into the first header means and the exhaust header, respective adjacent ducts defining air slots of predetermined width therebetween.

18. The pocket heat exchanger of claim 16 wherein there are four ducts arranged in parallel symmetry about the plane and extending between and opening into the first header means and the flue box.

19. The pocket heat exchanger of claim 17 wherein there are four ducts arranged in parallel symmetrical about the plane and extending between and opening into the first header means and the exhaust header.

20. In combination with a recirculatory fluid system having a plurality of walls, a working chamber, and passage means for continuously recirculating a gas through the working chamber, a pocket heat exchanger for heating the recirculating gas comprising:

a. a generally planar support plate removably mountable to selected walls of the recirculatory fluid system to cooperate therewith to form a generally enclosed pocket that opens into the recirculatory fluid system passage means;

b. a combustion chamber fastened to the support plate and located inside the pocket, the combustion chamber defining a longitudinal axis that is generally perpendicular to the plane of the support plate and a central plane that passes through the combustion chamber longitudinal axis;

c. burner means mounted to the support plate outside of the pocket for producing hot products of combustion inside the combustion chamber;

d. first header means located inside the pocket and arranged symmetrically about the central plane for transporting products of combustion from the combustion chamber;

e. duct means arranged symmetrically about the central plane for conducting products of combustion in parallel flow paths from the first header means and for enabling the recirculating gas to flow therepast to be heated by the products of combustion therein; and f. flue means arranged symmetrically about the central plane for venting the products of combustion from the duct means.

21. The combination of claim 20 wherein:

a. the combustion chamber has a first end that is fastened to the support plate and a second end; and b. the first header means comprises a U-shaped header having a base section that opens into the combustion chamber second end and a pair of upstanding legs joined to the base section.

22. The combination of claim 21 wherein:

a. the duct means comprises:

i. at least two primary ducts, each primary duct having a first end secured to and opening into an associated leg of the U-shaped header and a second end joined to the support plate, the primary ducts being symmetrically located about the vertical plane;

ii. a front header attached to the support plate outside of the pocket, the front header communicating with the second ends of the primary ducts;

iii. at least two secondary ducts having respective first ends joined to the support plate and opening into the front header and respective second ends, the secondary ducts being symmetrically located about the vertical plane;

iv. a back header located between the legs of the U-shaped header and secured to and opening into the second ends of the secondary ducts;

v. at least two tertiary ducts arranged symmetrically about the vertical plane and having respective first ends joined to and opening into the back header and respective second ends; and vi. a flue box located proximate the support plate between the secondary ducts, the flue box being joined to and opening into the second ends of the tertiary ducts; and b. the flue means comprises a flue connected to the flue box and passing through the pocket.

23. The combination of claim 22 wherein there are at least four primary ducts.

24. The combination of claim 21 wherein:

a. the duct means comprises:

i. at least two primary ducts, each primary duct having a first end secured to and opening into an associated leg of the U-shaped header and a second end joined to the support plate, the primary ducts being symmetrically located about the central plane;

ii. a front header attached to the support plate outside of the pocket, the front header communicating with the second ends of the primary ducts;

iii. at least two secondary ducts having respective first ends joined to the support plate and opening into the front header and respective second ends, the secondary ducts being symmetrically located about the central plane;

iv. a back header located between the legs of the U-shaped header and secured to and opening into the second ends of the secondary ducts;

v. at least two tertiary ducts arranged symmetrically about the central plane and having respective first ends joined to and opening into the back header and respective second ends joined to the support plate; and vi. an exhaust header attached to the support plate outside the pocket, the exhaust header being in communication with the second ends of the tertiary ducts; and b. the flue means comprises a flue connected to the exhaust header and passing outside of the pocket.

25. The combination of claim 24 wherein there are at least four primary ducts.

26. The combination of claim 21 wherein:

a. the duct means comprises:

i. at least two primary ducts, each primary duct having a first end secured to and opening into an associated leg of the U-shaped header and a second end joined to the support plate, the primary ducts being symmetrically located about the central plane;

ii. a front header attached to the support plate outside of the pocket, the front header communicating with the second ends of the primary ducts;

iii. at least two secondary ducts having respective first ends joined to the support plate and opening into the front header and respective second ends, the secondary ducts being symmetrically located about the central plane; and iv. a flue box located proximate the support plate between the secondary ducts, the flue box being joined to and opening into the second ends of the secondary ducts; and b. the flue means comprises a flue connected to the flue box and passing through the pocket.

27. The combination of claim 26 wherein there are at least four primary ducts.

28. The combination of claim 20 wherein:

a. the combustion chamber has a first end that is fastened to the support plate and a second end;

b. the duct means comprises:

i. a flue box located between the support plate and the first header means and proximate the support plate; and ii. at least two ducts arranged symmetrically about the central plane extending between and opening into the first header means and into the flue box; and c. the flue means comprises a flue connected to the flue box and passing through the pocket.

29. The combination of claim 28 wherein there are at least four ducts.

30. The combination of claim 20 wherein:

a. the combustion chamber has a first end that is fastened to the support plate and a second end;

b. the duct means comprises:

i. an exhaust header attached to the support plate outside of the pocket; and ii. at least two ducts arranged symmetrically about the central plane and extending between and opening into the first header means and the exhaust header; and c. the flue means comprises a flue connected to the exhaust header and passing outside of the pocket.

31. The combination of claim 30 wherein there are at least four ducts.

32. The combination of claim 20 wherein the duct means defines a plurality of slots having predetermined widths and arranged symmetrically about the central plane through which the process gas flows to thereby become heated by the products of combustion within the duct means.

33. The combination of claim 20 wherein the duct means and the first header means cooperate with selected walls of the recirculatory fluid system pocket to define auxiliary slots having predetermined widths for a portion of the recirculating gas to flow through and thereby become heated by the products of combustion within the duct means.

34. The combination of claim 20 further comprising shroud means mounted to selected walls of the recirculatory fluid system pocket for guiding the recirculating gas to flow through the pocket symmetrically around the first header means and the combustion chamber to thereby enable the pocket heat exchanger to heat the recirculating gas to a uniform temperature.

35. The combination of claim 34 wherein the shroud means comprises a pair of panels mounted to associated walls of the recirculatory fluid system pocket, the panels having respective contours that are symmetrical about the central plane and that are generally parallel to and spaced from selected surfaces of the first header means, the panels cooperating to direct recirculating gas flow symmetrically through the pocket.

36. A method of operating a recirculatory fluid system comprising the steps of:

a. providing a pocket heat exchanger having a combustion chamber that defines a longitudinal axis and a central plane passing through the longitudinal axis, a plurality of spaced apart ducts arranged symmetrically about the central plane, and a flue;

b. installing the pocket heat exchanger in a pocket of the recirculatory fluid system;

c. producing hot products of combustion in the combustion chamber of the pocket heat exchanger;

d. conducting the hot products of combustion from the combustion chamber in parallel flow paths through the ducts to the flue;

e. drawing a stream of recirculating gas to flow past the pocket heat exchanger ducts and the combustion chamber and heating the stream of recirculating gas to have a substantially uniform temperature across the stream cross section; and f. circulating the heated recirculating gas from the pocket to a working chamber and back to the pocket for reheating.

37. The method of claim 36 wherein the step of conducting hot products of combustion from the combustion chamber in parallel flow paths comprises the step of conducting the hot products of combustion from the combustion chamber in parallel flow paths through four passes from the combustion chamber to the flue.

38. The method of claim 36 wherein the step of conducting hot products of combustion from the combustion chamber in parallel flow paths comprises the step of conducting the hot products of combustion from the combustion chamber in parallel flow paths through three passes from the combustion chamber to the flue.

39. The method of claim 36 wherein the step of conducting hot products of combustion from the combustion chamber in parallel flow paths comprises the step of conducting the hot products of combustion from the combustion chamber in parallel flow paths through two passes from the combustion chamber to the flue.

40. The method of claim 36 wherein the step of installing a pocket heat exchanger in the pocket of the recirculatory fluid system comprises the step of installing the pocket heat exchanger flue in the stream of recirculating gas flowing past the pocket heat exchanger.

41. The method of claim 36 wherein the step of installing a pocket heat exchanger in the pocket of the recirculatory fluid system comprises the step of installing the pocket heat exchanger flue outside the stream of recirculating gas flowing past the pocket heat exchanger.

42. The method of claim 36 comprising the further steps of:

a. creating auxiliary slots of predetermined width between selected pocket heat exchanger ducts and the pocket of the recirculatory fluid system; and b. drawing a portion of the stream of recirculating gas to flow through the auxiliary slots and past the combustion chamber.

43. The method of claim 36 comprising the further steps of:

a. guiding the recirculating gas to flow symmetrically past the pocket heat exchanger; and b. scrubbing substantially all of the combustion chamber with the recirculating gas and thereby eliminating any hot spots on the combustion chamber.

44. The method of claim 43 wherein the step of guiding the recirculatory gas to flow symmetrically past the pocket heat exchanger comprises the steps of:

a. mounting a shroud to the pocket of the recirculatory fluid system spaced from and generally parallel to the combustion chamber longitudinal axis; and b. guiding the recirculating gas by the shroud to flow symmetrically past the combustion chamber.

45. Apparatus for transferring heat between first and second fluids comprising:

a. a generally flat support plate having first and second sides;

b. an elongated combustion chamber having a first end fastened to the first side of the support plate and a second end, the combustion chamber defining a longitudinal axis and a plane passing through the longitudinal axis;

c. burner means mounted to the support plate second side for burning a fuel in the combustion chamber and producing heated first fluid therein;

d. flue means symmetrical about the plane for venting the first fluid; and e. duct means arranged symmetrically about the plane for conducting the first fluid in at least two paths that are substantially parallel to the longitudinal axis from the combustion chamber to the flue means.

46. Apparatus for transferring heat between first and second fluids comprising:

a. a generally flat support plate having first and second sides;

b. an elongated combustion chamber having a first end fastened to the first side of the support plate and a second end, the combustion chamber defining a longitudinal axis and a plane passing through the longitudinal axis;

c. burner means mounted to the support plate second side for burning a fuel in the combustion chamber and producing heated first fluid therein;

d. flue means symmetrical about the plane for venting the first fluid; and e. duct means arranged symmetrically about the plane for conducting the first fluid in at least two parallel paths from the combustion chamber to the flue means wherein the duct means comprises a generally U-shaped header having a base portion that is supported on and opens into the combustion chamber second end and a pair of spaced apart legs joined to the base portion.

47. The apparatus of claim 46 wherein:

a. the flue means comprises a flue box proximate the support plate first side; and b. the duct means further comprises:

i. at least two primary ducts arranged symmetrically about the central plane and having respective first ends secured to and opening into respective legs of the U-shaped header and respective second ends secured to the support plate first side;

ii. at least two secondary ducts arranged symmetrically about the central plane and having respective first ends joined to the support plate on the first side thereof and respective second ends;

iii. at least two tertiary ducts arranged symmetrically about the central plane and having respective first ends joined to and opening into the flue box and respective second ends;

iv. a front header attached to the support plate second side and opening into the second ends of the primary ducts and into the first ends of the secondary ducts; and v. a back header secured to and opening into the second ends of the secondary ducts and into the second ends of the tertiary ducts, so that the first fluid flows in parallel paths through four passes from the combustion chamber to the flue box.

48. The apparatus of claim 47 wherein:

a. the back header is located between the legs of the U-shaped header; and b. the flue box is located between the tertiary ducts.

49. The apparatus of claim 47 wherein the U-shaped header, back header, flue box, primary ducts, secondary ducts, and tertiary ducts cooperate to define a plurality of slots for the passage of the second fluid therethrough to thereby be heated by the first fluid.

50. The apparatus of claim 46 wherein:

a. the flue means comprises an exhaust header joined to the support plate second side; and b. the duct means further comprises:

i. at least two primary ducts arranged symmetrically about the central plane and having respective first ends secured to and opening into respective legs of the U-shaped header and respective second ends secured to the support plate first side;

ii. at least two secondary ducts arranged symmetrically about the central plane and having respective first ends joined to the support plate on the first side thereof and respective second ends;

iii. at least two tertiary ducts arranged symmetrically about the central plane and having respective first ends joined to the support plate first side and opening into the exhaust header and respective second ends;

iv. a front header attached to the support plate second side and opening into the second ends of the primary ducts and into the first ends of the secondary ducts; and v. a back header secured to and opening into the second ends of the secondary ducts and into the second ends of the tertiary ducts, so that the first fluid flows in parallel paths through four passes from the combustion chamber to the exhaust header.

51. The apparatus of claim 50 wherein the U-shaped header, back header, primary ducts, secondary ducts, and tertiary ducts cooperate to define a plurality of slots for the passage of the second fluid therethrough to thereby be heated by the first fluid.

52. The apparatus of claim 46 wherein:

a. the flue means comprises a flue box located between the two legs of the U-shaped header; and b. the duct means comprises:

i. at least two primary ducts having respective first ends secured to and opening into respective legs of the U-shaped header and respective second ends secured to the support plate first side;

ii. at least two secondary ducts having respective first ends joined to the support plate on the first side thereof and respective second ends joined to and opening into the flue box; and iii. a front header attached to the support plate second side and opening into the second ends of the primary ducts and into the first ends of the secondary ducts, so that the first fluid flows in parallel paths through three passes from the combustion chamber to the flue box.

53. The apparatus of claim 52 wherein the U-shaped header, flue box, primary ducts, and secondary ducts cooperate to define a plurality of slots for the passage of the second fluid therethrough to thereby be heated by the first fluid.

54. Apparatus for transferring heat between first and second fluids comprising:

a. a generally flat support plate having first and second sides;

b. an elongated combustion chamber having a first end fastened to the first side of the support plate and a second end, the combustion chamber defining a longitudinal axis and a plane passing through the longitudinal axis;

c. burner means mounted to the support plate second side for burning a fuel in the combustion chamber and producing heated first fluid therein;

d. flue means symmetrical about the plane for venting the first fluid, wherein the flue means comprises a flue box proximate the support plate first side; and e. duct means arranged symmetrically about the plane for conducting the first fluid in at least two parallel paths from the combustion chamber to the flue means, wherein the duct means comprises:

i. first header means for transporting the first fluid from the combustion chamber; and ii. at least two ducts having respective first ends secured to and opening into the first header means and respective second ends joined to an opening into the flue box, so that the first fluid flows in parallel paths through two passes from the combustion chamber to the flue box.

55. Apparatus for transferring heat between first and second fluids comprising:

a. a generally flat support plate having first and second sides;

b. an elongated combustion chamber having a first end fastened to the first side of the support plate and a second end, the combustion chamber defining a longitudinal axis and a plane passing through the longitudinal axis;

c. burner means mounted to the support plate second side for burning a fuel in the combustion chamber and producing heated first fluid therein;

d. flue means symmetrical about the plane for venting the first fluid, wherein the flue means comprises an exhaust header joined to the support plate second side; and e. duct means arranged symmetrically about the plane for conducting the first fluid in at least two parallel paths from the combustion chamber to the flue means, wherein the duct means comprises:

i. first header means for transporting the first fluid from the combustion chamber; and ii. at least two ducts having respective first ends secured to and opening into the first header means and respective second ends joined to the support plate and opening into the exhaust header, so that the first fluid flows in parallel paths through two passes from the combustion chamber to the exhaust header.

* * * * *